US010135119B2

(12) United States Patent
Ku et al.

(10) Patent No.: US 10,135,119 B2
(45) Date of Patent: Nov. 20, 2018

(54) SMART ANTENNA AND WIRELESS DEVICE HAVING THE SAME

(71) Applicant: WISTRON NEWEB CORPORATION, Hsinchu (TW)

(72) Inventors: Kuang-Yuan Ku, Hsinchu (TW); Tsun-Che Huang, Hsinchu (TW); Cheng-Geng Jan, Hsinchu (TW); Chi-Kang Su, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 42 days.

(21) Appl. No.: 15/285,864

(22) Filed: Oct. 5, 2016

(65) Prior Publication Data

US 2017/0271748 A1 Sep. 21, 2017

(30) Foreign Application Priority Data

Mar. 16, 2016 (TW) ..... 105108126 A

(51) Int. Cl.

| | |
|---|---|
| ***H01Q 1/24*** | (2006.01) |
| ***H01Q 1/48*** | (2006.01) |
| ***H01Q 9/06*** | (2006.01) |
| ***H01Q 15/14*** | (2006.01) |
| ***H01Q 9/16*** | (2006.01) |
| ***H01Q 9/28*** | (2006.01) |
| ***H01Q 21/20*** | (2006.01) |
| ***H01Q 3/00*** | (2006.01) |
| ***H01Q 3/26*** | (2006.01) |

(52) U.S. Cl.

CPC ..... *H01Q 1/243* (2013.01); *H01Q 1/48* (2013.01); *H01Q 3/2629* (2013.01); *H01Q 9/065* (2013.01); *H01Q 9/285* (2013.01); *H01Q 15/14* (2013.01)

(58) Field of Classification Search

CPC H01Q 9/065; H01Q 9/16; H01Q 3/44; H01Q 15/002; H01Q 15/148; H01Q 3/2641; H01Q 5/357

See application file for complete search history.

(56) References Cited

U.S. PATENT DOCUMENTS

| | | | |
|---|---|---|---|
| 4,529,987 | A | 7/1985 | Bhartia et al. |
| 7,477,204 | B2 | 1/2009 | Lin et al. |
| 7,646,343 | B2 | 1/2010 | Shtrom et al. |

(Continued)

*Primary Examiner* — Dameon E Levi
*Assistant Examiner* — Ricardo Magallanes
(74) *Attorney, Agent, or Firm* — Li & Cai Intellectual Property (USA) Office

(57) ABSTRACT

A smart antenna comprises a dipole antenna, a first reflector unit, a first diode, a first RF choke unit and a second RF choke unit. The dipole antenna has a first radiating portion and a second radiating portion. The first radiating portion is used for feeding an RF signal and a DC voltage signal controlling the conduction status of the first diode simultaneously. The first reflector unit is disposed on a first side of the dipole antenna and parallel to the dipole antenna. A first section and a second section of the first reflector unit are electrically connected by the first diode. The first RF choke unit is electrically connected between the first radiating portion and the first section of the first reflector unit. The second RF choke unit is electrically connected between the second radiating portion and the second section of the first reflector unit.

16 Claims, 12 Drawing Sheets

(56) References Cited

U.S. PATENT DOCUMENTS

| | | | | |
|---|---|---|---|---|
| 2005/0062667 | A1* | 3/2005 | Shirosaka | H01Q 1/38 343/794 |
| 2010/0231453 | A1* | 9/2010 | Shinkai | H01Q 1/2291 342/368 |
| 2012/0021790 | A1* | 1/2012 | Kister | H04B 1/18 455/507 |

* cited by examiner

SMART ANTENNA AND WIRELESS DEVICE HAVING THE SAME

BACKGROUND OF THE INVENTION

1. Field of the Invention

The instant disclosure relates to an antenna and a wireless device having the same, and more particularly to a smart antenna and a wireless device having the same.

2. Description of Related Art

In general, the antennas used in the radio communication products are usually omnidirectional radiation field antennas, e.g. a dipole antenna. However, when the position of the product is fixed, the antenna in the product is only able to provide fixed radiation patterns for transmitting/receiving signals. Therefore, problems like bad transmission/reception signals that lead to a lower transmission speed are experienced when the signals are across different floors.

In the conventional antenna design, a plurality of antennas with fixed positions is used and switch components are used in coordination with the circuit board of the wireless module (or the circuit board of the whole system) to control the overall radiation pattern. However, the position for placing the antenna is always a fixed position in the product, there is a requirement to design the antenna in a more complicated way or employ more complex switch controls to achieve the purpose of controlling the radiation pattern. Thus the antenna designers are restricted to the overall product specification and thus a lot of design limitations are encountered while designing the antenna.

SUMMARY OF THE INVENTION

One aspect of the instant disclosure provides a smart antenna and wireless device having the same. The location of the driven switch component (diode) is in the antenna device itself and the switch component (diode) is designed to be integrated with the antenna. The radiation pattern of the dipole antenna may be changed conveniently so that the problems encountered in the prior art are solved by utilizing an antenna design with selecting radiation direction.

One of the embodiments of the instant disclosure provides a smart antenna comprising a dipole antenna, a first reflector unit, a first diode, a first RF choke unit and a second RF choke unit. The dipole antenna has a first radiating portion and a second radiating portion. The first radiating portion is used for feeding a RF (Radio Frequency) signal and a DC (Direct Current) voltage signal at the same time. The first reflector unit is disposed on a first side of the dipole antenna and parallel to the dipole antenna. A first section and a second section of the first reflector unit are electrically connected by the first diode. The DC voltage signal is used to control the conduction status of the first diode. The first RF choke unit is electrically connected between the first radiating portion and the first section of the first reflector unit. The second RF choke unit is electrically connected between the second radiating portion and the second section of the first reflector unit.

One of the embodiments of the instant disclosure provides a wireless communication device comprising a bias tee circuit, a DC voltage supply unit, a dipole antenna, a coaxial cable, a first reflector unit, a first diode, a first RF choke unit and a second RF choke unit. The bias tee circuit has a first end, a second end and a third end. The first end of the bias tee circuit receives a RF signal. The second end of the bias tee circuit receives a DC voltage signal. The third end outputs the RF signal and the DC voltage signal. The DC voltage supply unit is electrically connected to the second end of the bias tee circuit generating direct current voltage signal. The dipole antenna has a first radiating portion and a second radiating portion. The first radiating portion is used for feeding the RF (Radio Frequency) signal and the DC (Direct Current) voltage signal at the same time. The coaxial cable has a feed end and a ground end. The feed end is electrically connected between the third end of the bias tee circuit and the first radiating portion of the dipole antenna. The ground end is electrically connected between the second radiating portion of the dipole antenna and a system ground. The first reflector unit is disposed on a first side of the dipole antenna and is parallel to the dipole antenna. A first section and a second section of the first reflector unit are electrically connected by the first diode. The DC voltage signal is used to control the conduction status of the first diode. The first RF choke unit is electrically connected between the first radiating portion and the first section of the first reflector unit. The second RF choke unit is electrically connected between the second radiating portion and the second section of the first reflector unit.

To summarize the above, the embodiments of the instant disclosure provide a smart antenna and a wireless device having the same that changes the radiation pattern of the dipole antenna by switching on/off the diode in the antenna device. By switching the diode to adjust the radiation pattern, the smart antenna disclosed in the embodiments of the present invention may be disposed in any required (or possible) positions of the wireless communication device and thus improve product design and flexibility of application.

To further understand the techniques, means and effects of the instant disclosure applied for achieving the prescribed objectives, the following detailed descriptions and appended drawings are hereby referred to, such that, and through which, the purposes, features and aspects of the instant disclosure can be thoroughly and concretely appreciated. However, the appended drawings are provided solely for reference and illustration, without any intention to limit the instant disclosure.

DETAILED DESCRIPTION OF THE PREFERRED EMBODIMENTS

[The embodiments of a smart antenna and wireless device having the same]

Figure 1:
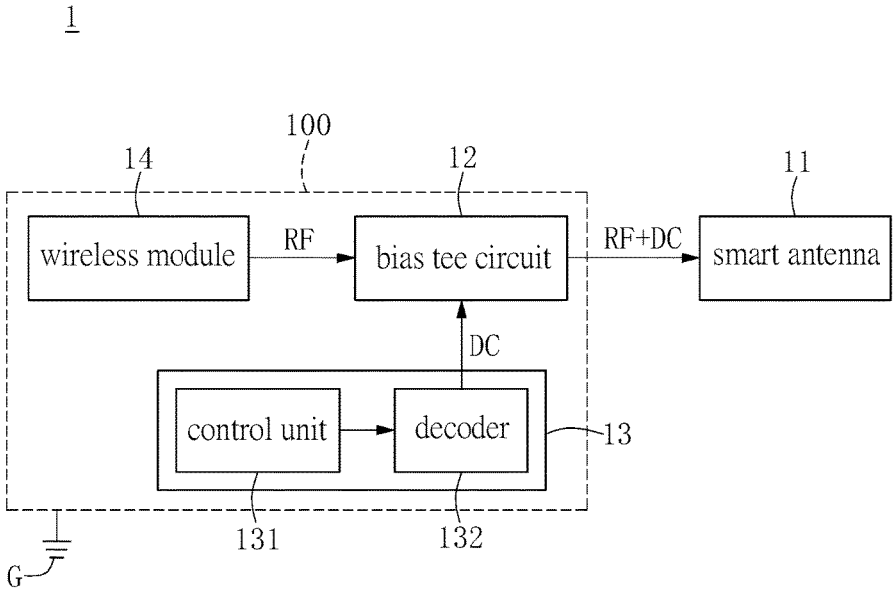
FIG. 1 shows a functional block diagram of a wireless communication device having a smart antenna, in accordance with an embodiment of the invention.

Referring to FIG. 1, FIG. 1 shows a functional block diagram of a wireless communication device having a smart antenna according to an embodiment of the invention. A wireless communication device 1 has a system circuit board 100 and further comprises a smart antenna 11, a bias tee circuit 12, a DC voltage supply unit 13 and a wireless module 14. The wireless communication device 1 may have other functional blocks or relative circuits which are left out in the following embodiments of the invention. For example, the wireless communication device 1 may be but not limited to a wireless router having a functional circuit or chip that is capable of following network protocols and having an algorithm for the execution of routing functions.

In one embodiment, the bias tee circuit 12, DC voltage supply unit 13 and wireless module 14 are disposed on the system circuit board 100 within the wireless communication device 1. The smart antenna 11 is independent of the system circuit board 100. In other words, the smart antenna 11 is separated from the system circuit board 100 by electrically connecting the coaxial cable to the bias tee circuit 12. The position of the smart antenna 11 is not restricted to be on the system circuit board 100.

The bias tee circuit 12 has a first end electrically connected to the wireless module 14, a second end electrically connected to the DC voltage supply unit 13 which generates direct current voltage signal DC, and a third end electrically connected to the smart antenna 11. The first end of the tee bias circuit 12 receives the radio frequency signal RF from the wireless module 14. Tee bias circuit 12 prevents the direct current voltage signal DC from transmitting to the wireless module 14. The second end of the bias tee circuit 12 receives the direct current voltage signal DC from the DC voltage supply unit 13. Tee bias circuit 12 prevents the RF signal from transmitting to the DC voltage supply unit 13.

The bias tee circuit 12 is a conventional three-port network. Its equivalent circuit consists of an equivalent capacitor (C) and an equivalent inductor (L). The equivalent capacitor is connected to the first end of the bias tee circuit 12, which allows the RF signal through and blocks the direct current voltage signal DC. The equivalent inductor is connected to the second end of the bias tee circuit 12 which allows the direct current voltage signal DC through and blocks the radio frequency signal RF. However, the present invention does not limit the way of implementing the bias tee circuit 12. The principle of a bias tee circuit 12 is known to those skilled in the art and thus its details are abbreviated here.

The DC voltage supply unit 13 may generate at least 2 levels of direct current voltage signal DC to control a driven element of the smart antenna 11 so that the radiation pattern can be configured. The driven element of the smart antenna 11 will be described in detail later. The direct current voltage signal DC generated by the DC voltage supply unit 13 is described here in detail. In one embodiment, the DC voltage supply unit 13 may generate 2 levels of direct current voltage signal DC, including a positive voltage +V (or a negative voltage −V) and a zero voltage (0V). In another embodiment, the DC voltage supply unit 13 may generate but is not limited to 3 levels of direct current voltage signal DC, including a positive voltage +V, a negative voltage −V and a zero voltage (0V). The DC voltage supply unit 13 may generate, but is not limited to, more than 3 levels of direct current voltage signal DC. In practice, the DC voltage supply unit 13 may include, but is not limited to, a control unit 131 and a decoder 132 as shown in FIG. 1. The radiation pattern of the smart antenna 11 is configured by the direct current voltage signal DC which is controlled by the DC voltage supply unit 13. The smart antenna of this embodiment will be described in detail hereafter.

Figure 2:
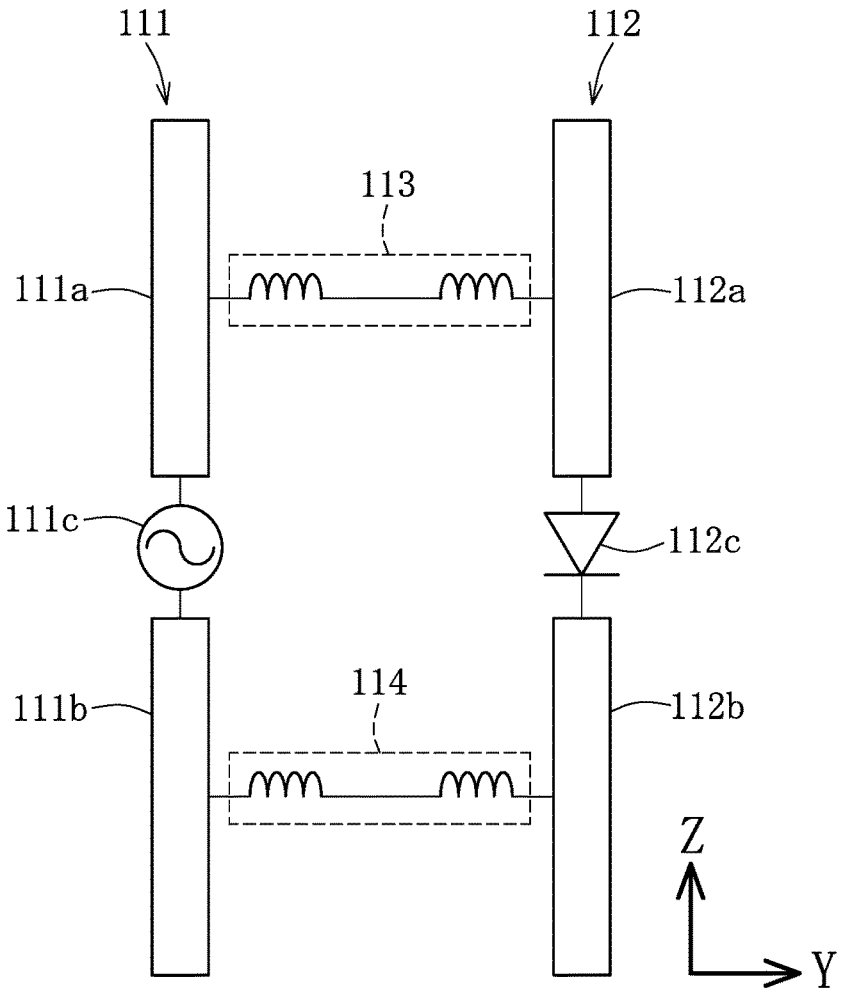
FIG. 2 shows a schematic diagram of the smart antenna, in accordance with an embodiment of the invention.

Please refer to FIG. 1 and FIG. 2. FIG. 2 provides a smart antenna according to an embodiment of the present invention. The smart antenna includes a dipole antenna 111, at least one reflector unit 112, at least one diode 112*c*, a first RF choke unit 113 and a second RF choke unit 114. The dipole antenna 111 has a first radiating portion 111*a* and a second radiating portion 111*b*. The dipole antenna 111 is usually implemented as a half-wave dipole antenna. The reflector unit 112 has a first section 112*a* and a second section 112*b*. A diode 112*c* is disposed between the first section 112*a* and the second section 112*b*. Since the diode 112*a* is controlled by the direct current voltage signal DC, the reflector unit 112 can be regarded as the driven element of the DC voltage supply unit 13. In FIG. 2, the reflector unit 112 is disposed on a side of the dipole antenna 111 and is parallel to the dipole antenna 111, e.g. on the right-hand side of the dipole antenna 111 as shown in FIG. 2. In a preferred embodiment, the distance between the reflector unit 112 and the dipole antenna 111 is, but is not limited to, ⅛ (0.125λ) to ¼ (0.25λ) of the wavelength that corresponds to the operating frequency of the dipole antenna 111.

The first radiating portion 111*a* of the dipole antenna 111 has a first feeding point (which is connected to the signal for example) and the second radiating portion 111*b* has a second feeding point (connected to the ground for example). As shown in FIG. 2, signal source 111*c* is connected to the first feeding point and the second feeding point. Diode 112*c* is electrically connected between first section 112*a* and second section 112*b*. Direct current voltage signal DC is for controlling the conduction status of the diode 112*c*. First RF choke unit 113 is electrically connected between first radiating portion 111*a* and the first section 112*a* of reflector unit 112. Second RF choke unit 114 is electrically connected between the second radiating portion 111*b* and the second section 112*b* of reflector unit 112.

The first radiating portion 111*a* of the dipole antenna 111 is for feeding the radio frequency signal RF and direct current voltage signal DC at the same time. The radio frequency signal RF is for exciting the radiation generation of the antenna. The direct current voltage signal DC is for controlling the conduction status of the diode 112*c*. When the direct current voltage signal DC is feeding through the first feeding point and the second feeding point of the dipole antenna 111 and the first feeding point is for inputting signal. The direct current voltage signal DC is transmitted to the diode 112*c* (e.g. the anode of the diode 112*c* shown in FIG. 2) via the first radiating portion 111*a*, the first RF choke unit 113 and the first section 112*a* of the reflector unit 112 and then (via the cathode of diode 112*c* shown in FIG. 2) the direct current voltage signal DC is transmitted back to the signal source 111*c* which is connected to the second feeding point via the second section 112*b* of the reflector unit 112, the second RF choke unit 114 and the second radiating portion 111*b* to form a loop. The direct current voltage signal DC generates voltage across the first RF choke unit 113, the second RF choke unit 114 and the diode 112*c*. By determining a suitable value of the direct current voltage signal DC, the voltage across two ends of the diode 112*c* is enough to turn on the diode 112*c* so that the first section 112*a* and the second section 112*b* of the reflector unit 112 are conducted to each other. For example, the value of the direct current voltage signal DC for turning on the diode is, but is not limited to, 3V. The direct current voltage signal DC may be provided by, but is not limited to, the operating voltage of the wireless communication device 1. On the contrary, when the direct current voltage DC is a zero voltage or a voltage that is not enough to turn on the diode 112*c*, the first section 112*a* and the second section 112*b* of the reflector unit 112 are not conducted to each other.

In a preferred embodiment, when the diode 112*c* is controlled and turned on by the direct current voltage signal DC, the total length of the first section 112*a*, the diode 112*c* and the second section 112*b* of the reflector unit 112 is at least half of the wavelength that corresponds to the operating frequency of the dipole antenna 111. However, the total length of the reflector unit 112 is not restricted to the present disclosure.

First RF choke unit 113 and second RF choke unit 114 allow direct current voltage signal DC to pass through and block the current generated by the radio frequency signal RF from the first radiating portion 111*a* and the second radiating portion 111*b* from transmitting to the reflector unit 112. The first RF choke unit 113 and the second RF choke unit 114 may individually include an RF choke element. The RF choke element may be, but is not limited to, an inductor. The number of inductors shown in FIG. 2 is for illustration purpose only and not intended for restricting the scope of the present invention.

Figure 3:
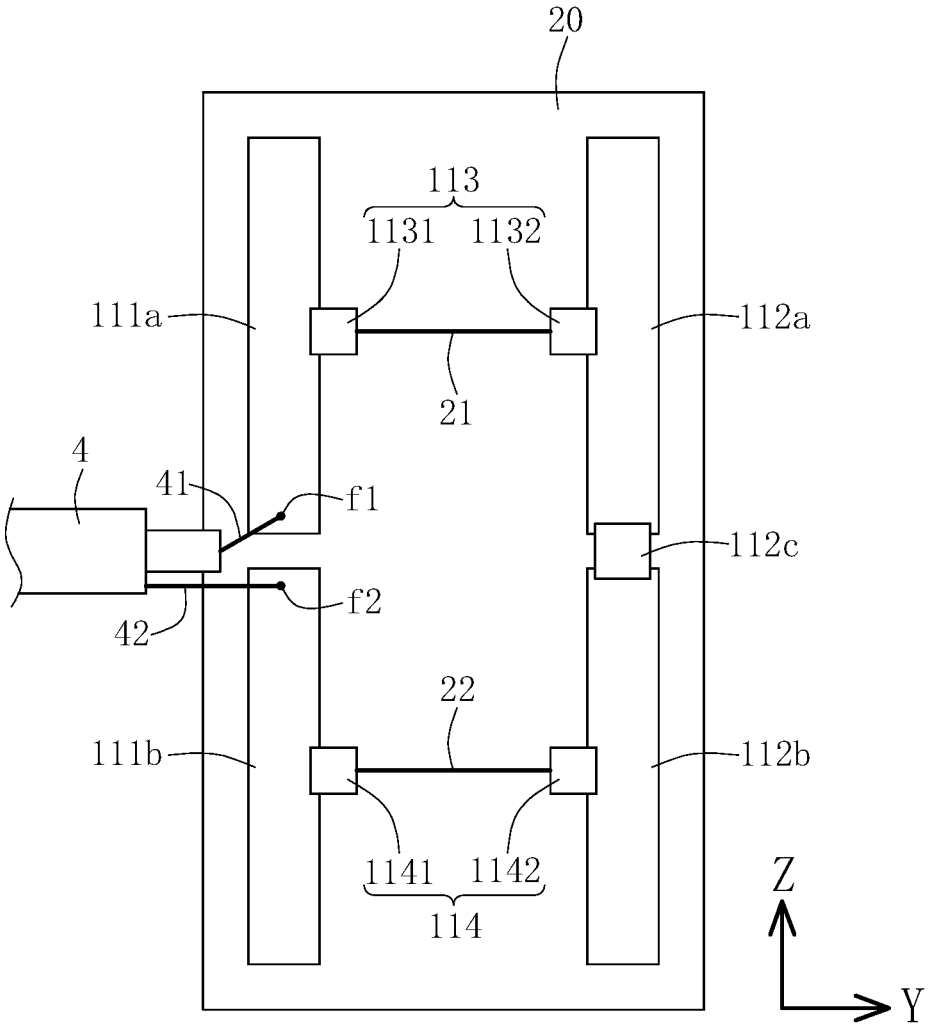
FIG. 3 shows a schematic diagram of implementing the smart antenna of FIG. 2 on a microwave substrate.

Furthermore, the smart antenna 11 may further include a coaxial cable 4 (as shown in FIG. 3). The coaxial cable 4 is electrically connected between the third end of the bias tee circuit 12 and the dipole antenna 111, thus the coaxial cable 4 may be the signal source of the dipole antenna 111 and make the bias tee circuit 12 feed the radio frequency signal RF and the direct current voltage signal DC to the dipole antenna 111. By utilizing the way the coaxial cable 4 is fed, it is easy to alter the position of the smart antenna 11 and improve the implementation flexibility of the smart antenna 11.

Please refer to both of FIG. 2 and FIG. 3. FIG. 3 shows a schematic diagram of implementing the smart antenna of FIG. 2 on a microwave substrate. In the embodiment shown in FIG. 3, the first radiating portion 111*a* and the second radiating portion 111*b* of the dipole antenna 111 and the first section 112*a* and the second section 112*b* of the reflector unit 112 may be formed by an etching process on the microwave substrate 20. The microwave substrate 20 may be, but is not limited to, a printed circuit board (PCB). The coaxial cable 4 has a feed end 41 and a ground end 42. The feed end 41 is electrically connected to the feeding point f1 of the first radiating portion 111*a*. The ground end 42 is electrically connected to the feeding point f2 of the second radiating portion 111*b*. The coaxial cable 4 is also electrically connected to the bias tee circuit 12 so the feed end 41 of the coaxial cable 4 is electrically connected between the third end of the bias tee circuit 12 and the first radiating portion 111*a* of the dipole antenna 111. The ground end 42 of the coaxial cable 4 is electrically connected between the second radiating portion 111*b* of the dipole antenna 111 and the system ground G. The system ground G is the ground of the wireless communication device 1 (i.e. the ground of the system circuit board 100 which has the bias tee circuit 12, direct current voltage supply unit 13 and the wireless module 14 disposed on it as shown in FIG. 1).

The first RF choke unit 113, second RF choke unit 114 and the diode 112*c* may be surface mounted devices (SMD) using but not limited to the surface mount technology to couple to the conductive contact terminals of the microwave substrate 20. Please refer to FIG. 3. The first RF choke unit 113 comprises a first RF choke element 1131 and a second RF choke element 1132 connected to each other in series. The first RF choke element 1131 and the second RF choke element 1132 may be connected directly by a wire 21. The wire 21 may be formed on the microwave substrate 20 by an etching process. The first RF choke element 1131 is connected directly to the first radiation portion 111*a* and the second RF choke element 1132 is connected directly to the first section 112*a* of the reflector unit 112. In an embodiment, it is preferable to arrange the first RF choke element 1131 close to the edge of the first radiating portion 111*a* and arrange the second RF choke element 1132 close to the edge of the first section 112*a* of the reflector unit 112. The second RF choke unit 114 includes a third RF choke element 1141 and a fourth RF choke element 1142 connected to each other in series. The third RF choke element 1141 and the fourth RF choke element 1142 may be connected directly by a wire 22. The wire 22 may be formed on the microwave substrate 20 by an etching process. The third RF choke element 1141 is connected directly to the second radiating portion 111*b* and the fourth RF choke element 1142 is connected directly to the second section 112*b* of the reflector unit 112. In another embodiment, it is preferable, but is not limited to, to arrange the third RF choke element 1141 close to the edge of the second radiating portion 111*b* and arrange the fourth RF choke element 1142 close to the edge of the second section 112*b* of the reflector unit 112.

Figure 4:
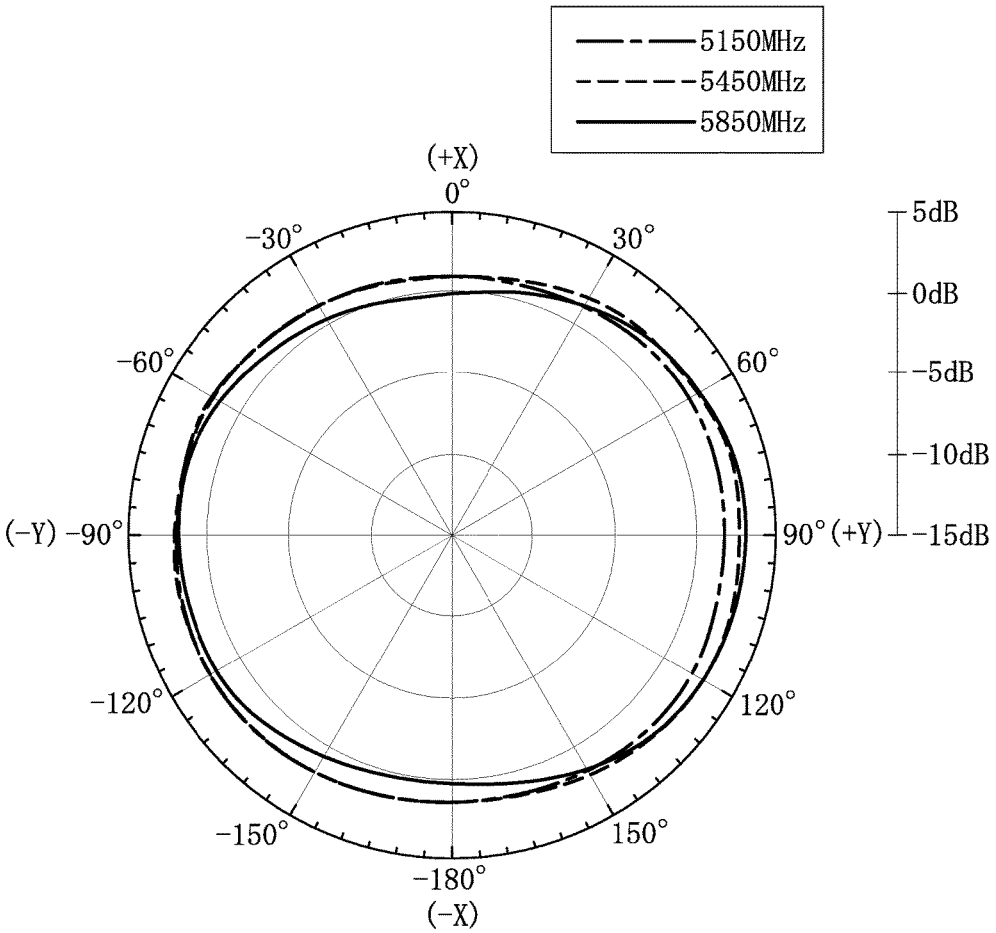
FIG. 4 shows a radiation pattern of the smart antenna of FIG. 2, wherein the diode of the smart antenna is in non-conducting state.
Figure 5:
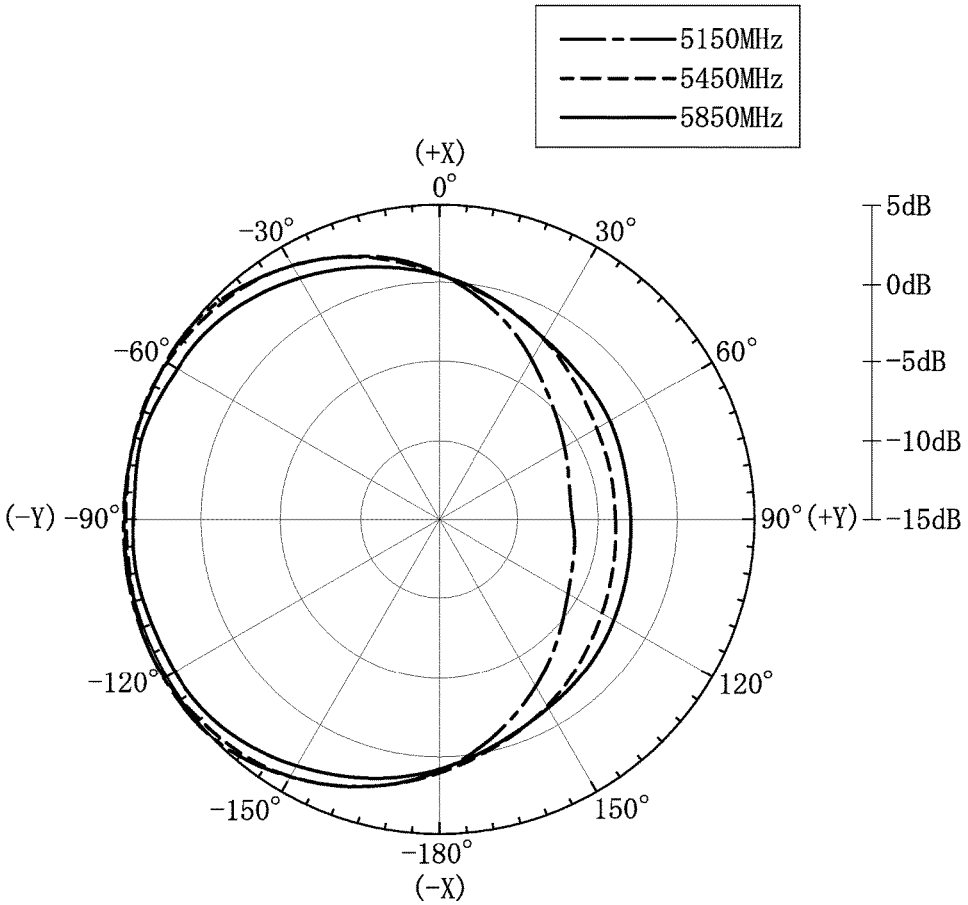
FIG. 5 shows a radiation pattern of the smart antenna of FIG. 2, wherein the diode of the smart antenna is in conducting state.

Please refer to FIG. 2 and FIG. 4. FIG. 4 shows a radiation pattern of the smart antenna of FIG. 2, wherein the diode of the reflector unit of the smart antenna is in a non-conducting state. When the direct current voltage signal DC is a zero voltage, the diode 112*c* is in a non-conducting state. Dipole antenna 111 is a half-wavelength dipole antenna with an operating frequency ranged between 5150 MHz to 5850 MHz. The radiation pattern on the X-Y plane is generally an omnidirectional radiation pattern. Please refer to FIG. 5. FIG. 5 shows a radiation pattern of the smart antenna of FIG. 2, wherein the diode of the reflector unit of the smart antenna is in a conducting state. When the direct current voltage signal DC is a positive voltage (e.g. +3V) and enough to turn on the diode 112*c*, the radiation pattern on the X-Y plane is altered and radiates towards left (in a negative Y direction at −90°) as shown in FIG. 5, whereas 0° indicates a positive X direction and 90° indicates a positive Y direction. In another embodiment, the reflector unit 112 of FIG. 2 may be disposed on the left of the dipole antenna 111 in accordance with the design concept described above, to have a reversed effect of configuring the radiation pattern of the antenna.

Figure 6:
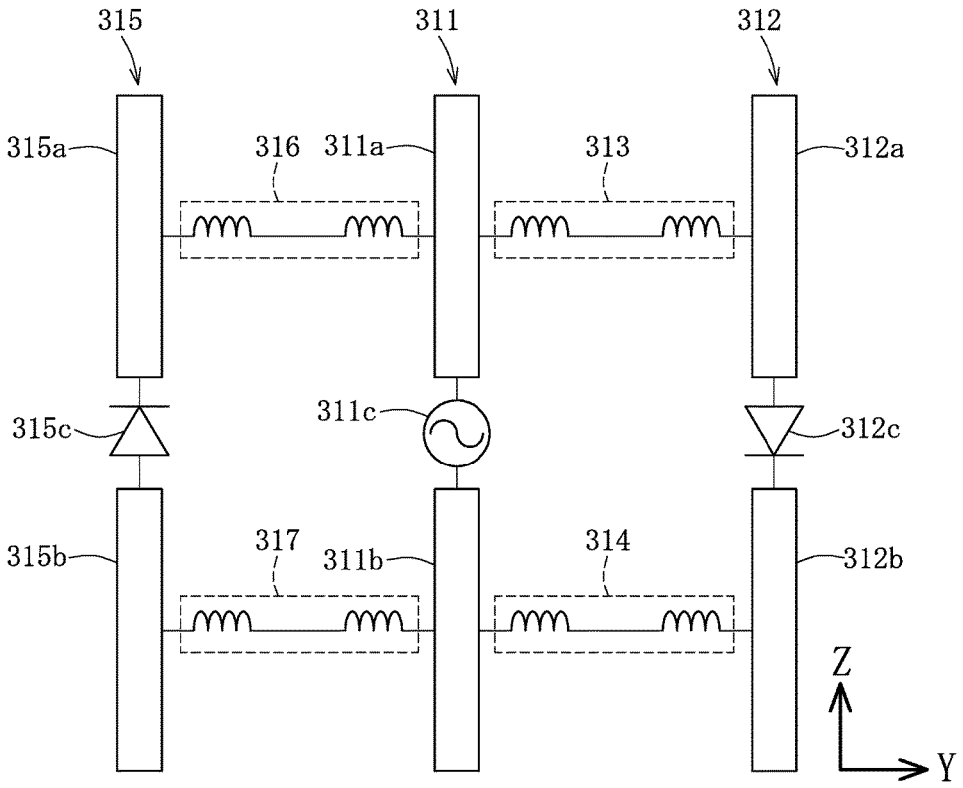
FIG. 6 shows a schematic diagram of the smart antenna, in accordance with another embodiment of the invention.

On the basis of design concept of the embodiment shown in FIG. 2, an embodiment of having two reflector units is shown in FIG. 6. In FIG. 6, the antenna has an extra reflector unit 315, a second diode 315*c* and RF reflector unit 316 and RF reflector unit 317 on the left side compared to the antenna shown in FIG. 2. In more detail, the antenna of FIG. 6 includes a dipole antenna 311, reflector units 312 and 315, a first diode 312*c*, a second diode 315*c* and RF choke units 313, 314, 316 and 317. The reflector unit 312 and the reflector unit 315 are disposed on the first side and the second side of the dipole antenna 311 respectively. As shown in FIG. 6, the reflector unit 312 is disposed on, but is not limited to, the right side of the dipole antenna 311 and the reflector unit 315 is disposed on, but is not limited to, the left side of the dipole antenna 311. However, this embodiment does not intend to limit the scope of the present invention. The relative positions of the reflector unit 312 on the first side and the reflector unit 315 on the second side may be arranged in three dimensional spaces. It is not necessary for the first side and the second side to be on the same plane.

The dipole antenna 311 has a first radiation portion 311*a* and a second radiation portion 311*b*. The anode of the first diode 312*c* is connected to an end of the first section 312*a* of the reflector unit 312. The cathode of the first diode 312*c* is connected to an end of the second section 312*b* of the reflector unit 312. The RF choke unit 313 is electrically connected between the first radiation portion 311*a* and the first section 312*a* of the reflector unit 312. The RF choke unit 314 is electrically connected between the second radiation portion 311*b* and the second section 312*b* of reflector unit 312. The reflector unit 315 has a third section 315*a* and a fourth section 315*b*. The cathode of the second diode 315*c* is connected to an end of the third section 315*a* of the reflector unit 315. The anode of the second diode 315*c* is connected to an end of the fourth section 315*b* of the reflector 315. The RF choke unit 316 is electrically connected between the first radiation portion 311*a* and the third section 315*a* of the reflector 315. The RF choke unit 317 is electrically connected between the second radiation portion 311*b* and the fourth section 315*b* of the reflector unit 315. In a preferred embodiment, the distance between the dipole antenna 311 and both of reflectors 312 and 315 are in, but are not limited to, a range of ⅛ (0.125λ) to ¼ (0.25λ) of the wavelength that corresponds to the operating frequency of the dipole antenna 311 respectively. The total length (when the diode is in conducting state) of the reflector unit 312 and the total length (when the diode is in conducting state) of the reflector unit 315 are at least, but are not limited to, half of the wavelength that corresponds to the operating frequency of the dipole antenna 311, respectively.

Figure 7:
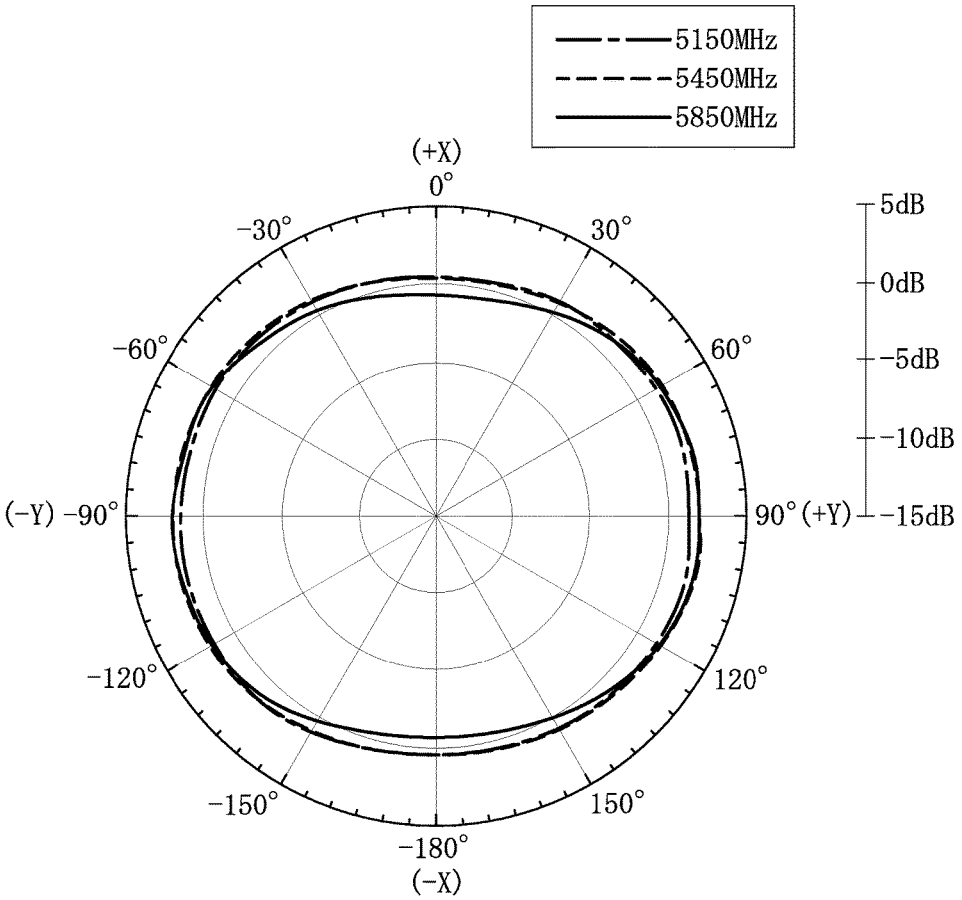
FIG. 7 shows a radiation pattern of the smart antenna of FIG. 6, wherein the DC voltage signal provided to two diodes is zero voltage.
Figure 8:
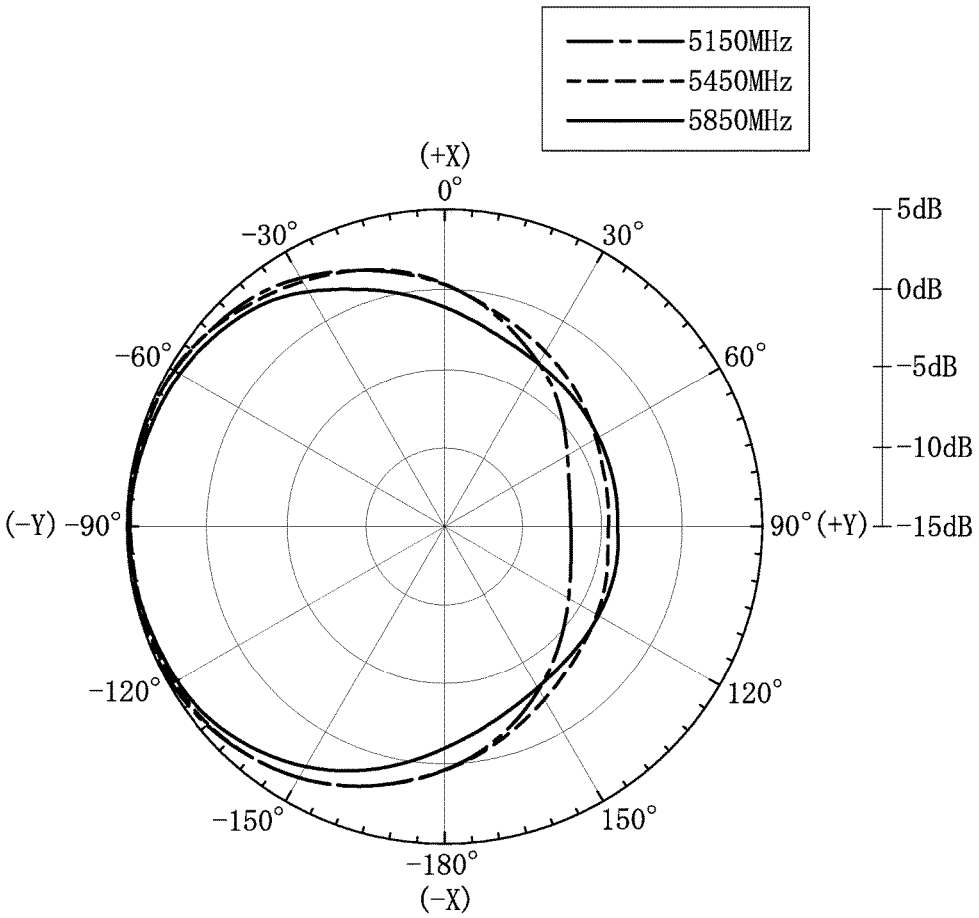
FIG. 8 shows a radiation pattern of the smart antenna of FIG. 6, wherein the DC voltage signal provided to two diodes is positive voltage which makes the first diode in conducting state and the second diode in non-conducting state.
Figure 9:
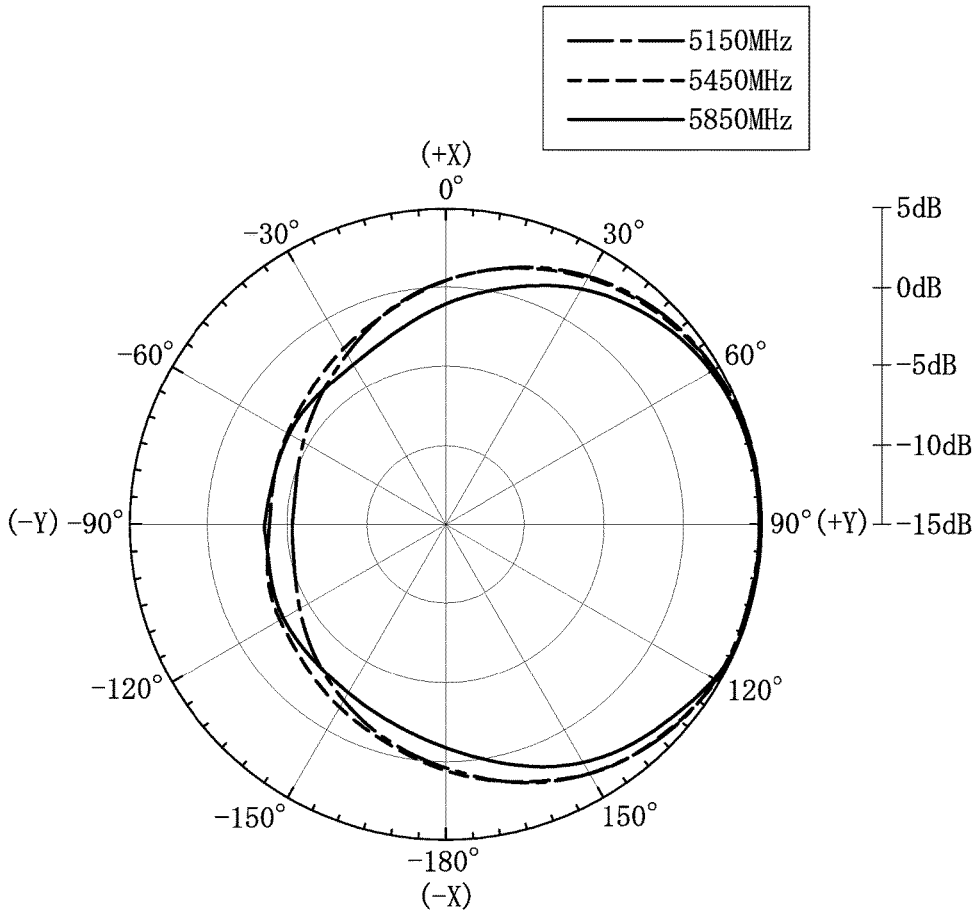
FIG. 9 shows a radiation pattern of the smart antenna of FIG. 6, wherein the DC voltage signal provided to the two diodes is negative voltage which makes the first diode in non-conducting state and the second diode in conducting state.

When the direct current voltage signal DC is a zero voltage, the first diode 312*c* and the second diode 315*c* are not conducted. The radiation pattern of the antenna shown in FIG. 6 is generally omnidirectional on the X-Y plane as shown in FIG. 7. When the direct current voltage signal DC is a positive voltage and makes the first diode 312*c* in a conducting state (while the second diode 315*c* is in a non-conducting state), the radiation pattern is configured to radiate towards the left (in a negative Y direction) on the X-Y plane as shown in FIG. 8. When the direct current voltage signal DC is a negative voltage and makes the second diode 315*c* in a conducting state (while the first diode 312*c* is in a non-conducting state), the radiation pattern is configured to radiate towards the right (in a positive Y direction) on the X-Y plane as shown in FIG. 9. According to the design concept described, the position of the first diode 312*c* of reflector unit 312 and the second diode 315*c* of reflector unit 315 is interchangeable so that an effect of configuring an opposite radiation pattern is obtained.

Figure 10:
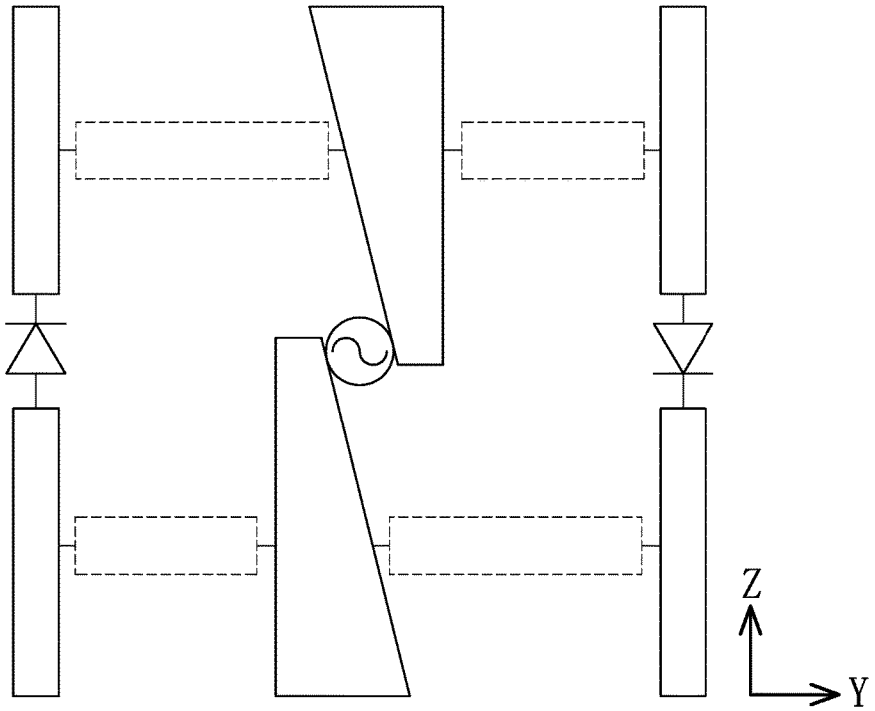
FIG. 10 shows a schematic diagram of the smart antenna, in accordance with another embodiment of the invention.

Furthermore, there is no restriction on the shape of the dipole antenna used in the embodiments, e.g. two radiation portions of the dipole antenna may be, but are not limited to, a trapezium as shown in FIG. 10. Two radiation portions of the dipole antenna may have at least one bend, or be in other shapes.

Figure 11:
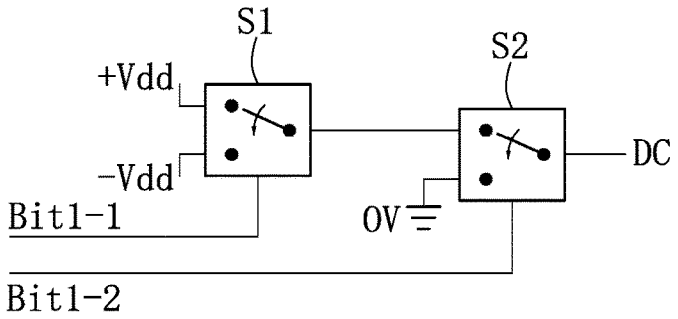
FIG. 11 shows a circuit diagram of a decoder of the DC voltage supply unit of FIG. 1.

Now refer to FIG. 1. When the smart antenna of this embodiment is implemented on a wireless communication device, direct current voltage supply unit 13 is for controlling the configuration of the radiation pattern of the smart antenna 11. The conduction status of the diode of every reflector unit is determined by a direct current voltage signal. When using two reflector units (as the design shown in FIG. 6), two direct current voltage signals may be needed to determine the individual conduction status of the two diodes. Referring to FIG. 11, FIG. 11 shows a circuit diagram of a decoder 132 of the DC power supply unit 13 of FIG. 1. The decoder 132 of FIG. 11 may be implemented as, but is not limited to, for example, a design of the smart antenna having two reflector units as shown in FIG. 6. The decoder 13 of FIG. 1 includes two Single-Pole-Double-Throw (SPDT) switches S1 and S2. The control unit 131 of FIG. 1 generates control signals such as parallel signals Bit1-1 and Bit1-2 to control the SPDT switches S1 and S2 respectively. SPDT switch S1 receives two non-zero voltages, namely a positive voltage +Vdd and a negative voltage −Vdd. The parallel signal Bit1-1 controls the SPDT switch S1 to determine whether a positive voltage +Vdd or a negative voltage −Vdd should be transmitted to the SPDT switch S2. SPDT switch S2 receives the direct current voltage (+Vdd or −Vdd) from SPDT switch S1 and zero voltage (ground, 0V). The parallel signal Bit1-2 controls the SPDT switch S2 to determine whether a zero voltage or the direct current voltage (+Vdd or −Vdd) from the SPDT switch S1 should be transmitted to the bias tee circuit 12.

Figure 12:
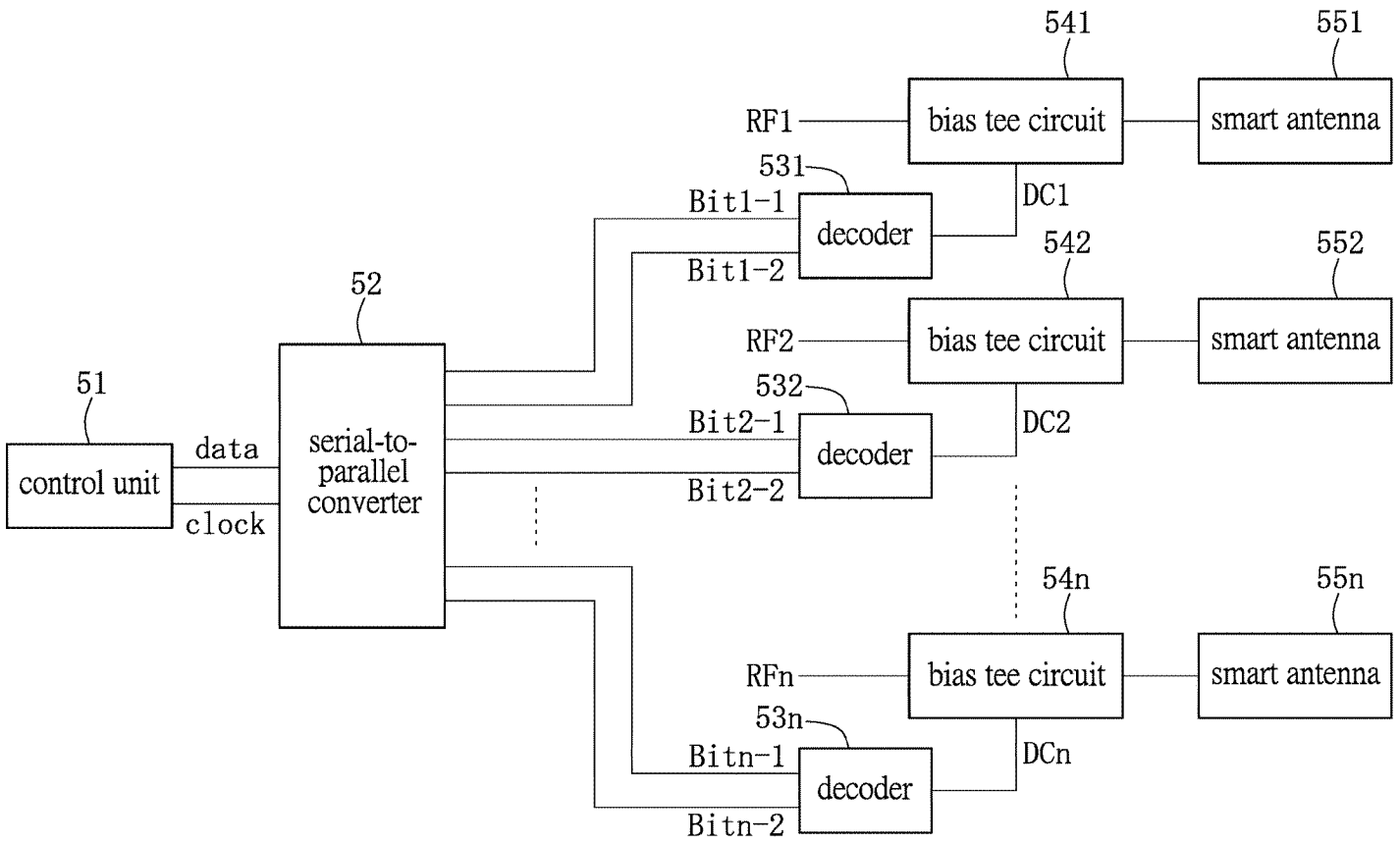
FIG. 12 shows a functional block diagram of a wireless communication device having a smart antenna, in accordance with another embodiment of the invention.

The wireless communication device of FIG. 1 uses the embodiment using one smart antenna. The embodiment can be extended further by using a plurality of smart antennas (two or above). Please refer to FIG. 12, a plurality of direct current voltage signals (DC1, DC2, . . . DCn) is provided to control the configuration of the radiation pattern of a plurality of smart antennas 551, 552, . . . 55*n* so as to adjust the overall radiation pattern of the smart antenna system. As shown in FIG. 12, based on the design concept of FIG. 1, the DC voltage supply unit includes a control unit 51, a serial-to-parallel converter 52 and a plurality of decoders 531, 532, . . . 53*n*. The control unit 51 is electrically connected to the serial-to-parallel converter 52 and transmits the serial control signals (including data and clock) to the serial-to-parallel converter 52. The serial-to-parallel converter 52 is electrically connected to decoders 531, 532, . . . 53*n* and converts the serial control signals into the parallel control signals to the respective decoders 531~53*n*. The decoders 531, 532, . . . 53*n* are electrically connected to the respective bias tee circuit 541, 542, . . . 54*n* to transmit the corresponding direct current voltage signals DC1, DC2 . . . DCn. Bias tee circuit 541 transmits the radio frequency signal RF1 and direct current voltage signal DC1 to the smart antenna 551. Bias tee circuit 542 transmits the radio frequency signal RF2 and direct current voltage signal DC2 to the smart antenna 552 and so on and so forth, so bias tee circuit 54*n* transmits the radio frequency signal RFn and direct current voltage signal DCn to the smart antenna 55*n*. The individual radiation pattern of the smart antennas 551, 552, . . . 55*n* may be controlled by controlling the corresponding direct current voltage signals DC1, DC2, . . . DCn so the desired overall radiation patterns may be configured.

In conclusion, the smart antenna and the wireless communication device thereof provided in the described embodiments may utilize the bias tee circuit to combine the direct current voltage signal and the radio frequency signal; and utilize the design concept of utilizing the direct current voltage signal to control the conduction status of the diode in order to adjust the electrical length of the reflector unit to form a reflector, so that the smart antenna may be implemented. The design of the smart antenna disclosed in the aforementioned embodiments has the following desirable benefits, the radiation pattern of the antenna is controlled, it is easy to implement, the manufacturing cost is low and the size is small. By implementing the antenna disclosed in the embodiments on a wireless communication device, the product has the desirable effect that the radiation pattern can be configured in different directions that are far more than the conventional antenna could achieve and the gain of the antenna can be enhanced more than 2 dB. Further, by integrating the switch component (the diode) with the antenna and utilizing the feed end 41 of the coaxial cable, the smart antenna can be arranged in any desired (or possible) position thereby increasing the flexibility of product design and application of the product.

The aforementioned descriptions merely represent the preferred embodiments of the instant disclosure, without any intention to limit the scope of the instant disclosure which is fully described only within the following claims. Various equivalent changes, alterations or modifications based on the claims of the instant disclosure are all, consequently, viewed as being embraced by the scope of the instant disclosure.

What is claimed is:

1. A smart antenna, comprising:

a dipole antenna having a first radiation portion and a second radiation portion, the first radiation portion being used for feeding an radio frequency signal and a direct current voltage signal at the same time;

a first reflector unit having a first section and a second section, the first reflector unit disposed on a first side of the dipole antenna;

a first diode electrically connected between the first section and the second section, the direct current voltage signal controlling a conduction status of the first diode;

a first RF choke unit electrically connected between the first radiating portion and the first section;

a second RF choke unit electrically connected between the second radiating portion and the second section; and a coaxial cable having a feed end and a ground end, the feed end being electrically connected to the first radiation portion and the ground end being electrically connected to the second radiation portion, wherein the coaxial cable feeds the radio frequency signal and the direct current voltage signal to the first radiation portion of the dipole antenna at the same time;

wherein the direct current voltage signal is for controlling the conduction status of the first diode; and wherein when the first diode is turned on by the direct current voltage signal, the first section and the second section of the first reflector unit are conducted to each other, and a radiation pattern of the smart antenna radiates toward a first direction.

2. The smart antenna of claim 1, further comprising:

a second reflector unit; and a second diode;

wherein the first reflector unit is disposed on the first side of the dipole antenna and parallel to the dipole antenna, the anode of the first diode is electrically connected to an end of the first section of the first reflector unit, and the cathode of the first diode is electrically connected to an end of the second section of the first reflector unit;

wherein the second reflector unit has a third section and a fourth section disposed on a second side of the dipole antenna and parallel to the dipole antenna, a cathode of the second diode is electrically connected to an end of the third section of the second reflector unit, and an anode of the second diode is electrically connected to an end of the fourth section of the second reflector unit;

wherein the direct current voltage signal is for controlling a conduction status of the second diode;

wherein when the second diode is turned on by the direct current voltage signal, the third section and the fourth section of the second reflector unit are conducted to each other, and the radiation pattern of the smart antenna radiates toward a second direction.

3. The smart antenna of claim 1, wherein the first RF choke unit comprises a first RF choke element and a second RF choke element connected to each other in series, the first RF choke element directly connects to the first radiation portion, and the second RF choke element directly connects to the first section of the first reflector unit; and wherein the second RF choke unit comprises a third RF choke element and a fourth RF choke element connected to each other in series, the third RF choke element directly connects to the second radiation portion, and the fourth RF choke element directly connects to the second section of the first reflector unit.

4. The smart antenna of claim 1, wherein when the first diode is controlled and turned on by the direct current voltage signal, and a total length of the first section, the first diode and the second section is at least ½ of a wavelength corresponding to an operating frequency of the dipole antenna.

5. The smart antenna of claim 1, wherein a distance between the first reflector unit and the dipole antenna is in a range of ⅛ to ¼ of the wavelength corresponding to the operating frequency of the dipole antenna.

6. A wireless communication device, comprising:

a system circuit board for sending a radio frequency signal and a direct current voltage signal; and a smart antenna, comprising:

a dipole antenna having a first radiation portion and a second radiation portion, the first radiation portion being used for feeding the radio frequency signal and the direct current voltage signal at the same time;

a first reflector unit having a first section and a second section, the first reflector unit disposed on a first side of the dipole antenna;

a first diode electrically connected between the first section and the second section, the direct current voltage signal controlling a conduction status of the first diode;

a first RF choke unit electrically connected between the first radiation portion and the first section of the first reflector unit;

a second RF choke unit electrically connected between the second radiation portion and the second section of the first reflector unit; and a coaxial cable electrically connected between the system circuit board and the smart antenna, wherein the coaxial cable has a feed end and a ground end, the feed end is electrically connected to the first radiation portion, and the ground end is electrically connected to the second radiation portion, wherein the coaxial cable feeds the radio frequency signal and the direct current voltage signal to the first radiation portion of the dipole antenna at the same time;

wherein the direct current voltage signal is for controlling the conduction status of the first diode; and wherein when the first diode is turned on by the direct current voltage signal, the first section and the second section of the first reflector unit are conducted to each other, and a radiation pattern of the smart antenna radiates toward a first direction.

7. The wireless communication device of claim 6, wherein the system circuit board further comprising a bias tee circuit and a direct current voltage supply unit, wherein the bias tee circuit having a first end, a second end and a third end, the first end of the first bias tee circuit receiving the radio frequency signal, the second end of the first bias tee circuit receiving the direct current voltage signal, wherein the direct current voltage supply unit electrically connected to the second end of the bias tee circuit and generating the direct current voltage signal, wherein the feed end electrically connected between the third end of the bias tee circuit and the first radiation portion of the dipole antenna, the ground end electrically connected between the second radiation portion of the dipole antenna and a system ground.

8. The wireless communication device of claim 7, wherein the first RF choke unit comprises a first RF choke element and a second RF choke element connected to each other in series, the first RF choke element connects directly to the first radiation portion, and the second RF choke element connects directly to the first section of the first reflector unit;

wherein the second RF choke unit comprises a third RF choke element and a fourth RF choke element connected to each other in series, the third RF choke element connects directly to the second radiation portion, and the fourth RF choke element connects directly to the second section of the first reflector unit.

9. The wireless communication device of claim 7, wherein when the first diode is controlled and turned on by the direct current voltage signal, and a total length of the first section, the second section and the first diode is at least half of a wavelength that corresponds to an operating frequency of the dipole antenna.

10. The wireless communication device of claim 7, wherein a distance between the first reflector unit and the dipole antenna is in a range of ⅛ to ¼ of the wavelength that corresponds to the operating frequency of the dipole antenna.

11. The wireless communication device of claim 7, wherein the direct current voltage supply unit comprises a control unit and a decoder, the decoder receiving a control signal from the control unit, determining the direct current voltage signal according to the control signal, and transmitting the direct current voltage signal to the bias tee circuit.

12. The wireless communication device of claim 7, further comprising a second reflector unit and a second diode, wherein the first reflector unit is disposed on the first side of the dipole antenna and parallel to the dipole antenna, an anode of the first diode is electrically connected to an end of the first section of the first reflector unit, and a cathode of the first diode is electrically connected to an end of the second section of the first reflector unit;

wherein the second reflector unit is disposed on a second side of the dipole antenna and parallel to the dipole antenna, the second reflector unit has a third section and a fourth section, an cathode of the second diode is electrically connected to an end of the third section of the second reflector unit, and an anode of the second diode is electrically connected to an end of the fourth section of the second reflector unit;

wherein the direct current voltage signal is for controlling a conduction status of the second diode; and wherein when the second diode is turned on by the direct current voltage signal, the third section and the fourth section of the second reflector unit are conducted to each other, and the radiation pattern of the smart antenna radiates toward a second direction.

13. The smart antenna of claim 1, wherein the first RF choke unit, the first section, the first diode, the second section, and the second RF choke unit are connected in series with each other.

14. The smart antenna of claim 6, wherein the first RF choke unit, the first section, the first diode, the second section, and the second RF choke unit are connected in series with each other.

15. The smart antenna of claim 1, wherein the direct current voltage signal is transmitted to the first diode via the feed end, the first radiating portion, the first RF choke unit and the first section of the first reflector unit, and then the direct current voltage signal is transmitted back to the ground end via the second section of the first reflector unit, the second RF choke unit and the second radiating portion to form a loop.

16. The smart antenna of claim 6, wherein the direct current voltage signal is transmitted to the first diode via the feed end, the first radiating portion, the first RF choke unit and the first section of the first reflector unit, and then the direct current voltage signal is transmitted back to the ground end via the second section of the first reflector unit, the second RF choke unit and the second radiating portion to form a loop.

* * * * *